US007027607B2

(12) United States Patent
Pedersen et al.

(10) Patent No.: US 7,027,607 B2
(45) Date of Patent: Apr. 11, 2006

(54) HEARING AID WITH ADAPTIVE MICROPHONE MATCHING

(75) Inventors: Brian Dam Pedersen, Ringsted (DK); René Mortensen, Copenhagen V (DK)

(73) Assignee: GN Resound A/S, Taastrup (DK)

( * ) Notice: Subject to any disclaimer, the term of this patent is extended or adjusted under 35 U.S.C. 154(b) by 1022 days.

(21) Appl. No.: 09/960,018

(22) Filed: Sep. 20, 2001

(65) Prior Publication Data

US 2004/0057593 A1 Mar. 25, 2004

(30) Foreign Application Priority Data

Sep. 22, 2000 (DK) ..... 2000 01407

(51) Int. Cl.
*H04R 25/00* (2006.01)

(52) U.S. Cl. ..... 381/313; 381/92

(58) Field of Classification Search ..... 381/91–93, 381/83, 95–96, 101–102, 104, 106–109, 381/111, 113, 317–318, 58
See application file for complete search history.

(56) References Cited

U.S. PATENT DOCUMENTS 5,463,694 A * 10/1995 Bradley et al. ..... 381/92
5,608,803 A 3/1997 Magotra et al.
5,687,241 A 11/1997 Ludvigsen
5,901,230 A * 5/1999 Walker ..... 381/66
6,205,225 B1 * 3/2001 Orban ..... 381/94.8
6,385,323 B1 * 5/2002 Zoels ..... 381/313
6,711,271 B1 * 3/2004 Hou ..... 381/323
2002/0034310 A1 * 3/2002 Hou ..... 381/92

FOREIGN PATENT DOCUMENTS

DE 19822021 A1 5/1998
DE 19849739 A1 10/1998
EP 1191817 A1 * 3/2002

* cited by examiner

*Primary Examiner*—Sinh Tran
*Assistant Examiner*—Phylesha L Dabney
(74) *Attorney, Agent, or Firm*—Michael J. Bolan; Bingham McCutchen LLP

(57) ABSTRACT

A method and apparatus for matching or balancing average signal levels between at least two input signal channels and their respective microphone elements so as to allow a hearing aid or instrument to maintain optimum directional characteristics over time are provided. The hearing aid may comprise an analogue signal processor or a digital signal processor adapted for controlling characteristics, e.g., gain and/or frequency response, of one or more of the input signal channels.

26 Claims, 2 Drawing Sheets

HEARING AID WITH ADAPTIVE MICROPHONE MATCHING

FIELD OF THE INVENTION

The present invention relates to a hearing aid or instrument which is adapted to match or balance average signal levels between at least two input signal channels and their respective microphone elements so as to allow the hearing aid to maintain optimum directional characteristics over time. The present invention furthermore relates to a corresponding method of operating a hearing aid. The hearing aid may comprise an analogue signal processor or a Digital Signal Processor (DSP) adapted to control characteristics, e.g. gain and/or frequency response, of one or more of the input signal channels.

BACKGROUND OF THE INVENTION

Hearing aids with adaptive microphone matching systems that seek to balance long term characteristics of a pair of omni-directional microphones are known in the art. DE 198 22 021 to Siemens discloses a directional hearing aid with an adaptive analogue matching circuit which controls the gain of an adjustable preamplifier in an input signal channel. The value of the gain is derived from a measured difference in average output signal level between the input signal channels.

DE 198 49 739 to Siemens discloses a directional hearing aid that also comprises a pair of microphones and associated input signal channels. A DSP based adaptive matching algorithm is employed that allow characteristics of one of the input signal channels to be adjusted by a control element arranged in a feed-forward error correction loop. The error correction loop operates to determine a difference in average signal level between the pair of microphones and uses a detected difference to adjust a setting of the control element.

The above-mentioned hearing aids aim at compensating for long term drift in characteristics of the employed microphones and/or aim at making it feasible to use relatively low cost unmatched microphone pairs. However, there remains a need in the art for an adaptive matching methodology and hearing aid that allow for long time constants, preferably in the order of hours or days, for the adaptive matching process to avoid audible modulation of the microphone signal(s). The adaptive matching methodology employed should preferably also be well suited for implementation in a low power DSP of a digital hearing aid. Furthermore, the above-mentioned prior-art adaptive matching circuits and methods also lack means which are able to detect anomalous input signal conditions and either slow down or completely halt the adaptive matching process under such conditions e.g. by suitably steering the adjustment of a controlled element(s). Field trials and clinical research performed by the present inventors have demonstrated that an erroneous matching between the input signal channels is likely to occur if the adaptive matching process is allowed to continue, i.e. by adjusting the correction parameter value, under such anomalous input signal conditions.

Due to severe constraints on power consumption and size of hearing aid DSPs, it would furthermore be highly advantageous to design the adaptive matching circuit or algorithm in a way that minimises the use of DSP hardware and software resources, e.g. data word lengths and computational load, in particular multiplications.

DESCRIPTION OF THE INVENTION

A first aspect of the invention relates to a hearing aid comprising:

a first input signal channel adapted to generate a first input signal associated with a first microphone, a second input signal channel adapted to generate a second input signal associated with a second microphone, and a processor adapted to determine a difference in average signal level between the first and second input signals, integrate the difference in average signal level over time to determine a differential level value and compare the differential level value to a threshold value, adjust a correction parameter value of at least one input signal channel based on the result of said comparison to reduce the difference in average signal level between the first and second input signals.

In the present specification and claims, the term "processor" designates one or several separate processors and its/their associated registers and/or memory circuitry. The processor may be arranged on a common integrated circuit substrate or distributed over several integrated circuit substrates. In case the processor comprises two or more separate processors, e.g. a DSP and an industry-standard microcontroller, each processor may be adapted to perform individually tailored and specific task(s) of the adaptive matching process. Thereby, dividing a total computational, or processing, load into appropriate subtasks tailored to the specific characteristics of each processor.

The processor may comprise an analogue signal processor operating on an analogue, i.e. continues time or sampled, versions of the first and second input signals. An analogue processor may perform an integration of the difference in average signal level over time by utilising a continues time or switched-capacitor type integrator. Likewise, a continues time or switched-capacitor type comparator may be adapted to compare the differential level value to the threshold value. The adjustment of the value of the correction parameter may be effected by adapting the processor to adjust a gain of a programmable preamplifier, e.g. by programming a suitable resistor or resistor array, arranged in the at least one input signal channel. The analogue processor may also comprise digital control circuitry and analogue-to-digital converters that are used to e.g. determine the differential level value and perform the comparison with the threshold value so that algebraic calculations at least partly replace corresponding analogue signal processing operations. Alternatively, the processor may comprise a DSP adapted to determine and integrate the difference in average signal level between the first and second input signals and compare the differential level value to the threshold value. In that embodiment of the invention, the first and second input signals are represented by respective digital input signals. These digital versions of the first and second input signals may be generated by two analogue-to-digital converter located within the respective input signal channels or generated by a single time-multiplexed analogue-to-digital converter.

The difference in average signal level between the first and second input signals may be represented by a value that has been obtained by subtracting an average signal level of the first input signal from an average signal level of the second input signal. Alternatively, the difference in average signal level may be represented by a ratio between the average signal level of the first input signal and the average signal level of the second input.

The integration of the difference in average signal level may be accomplished by a squaring each of the first and second input signals, either on a sample-by-sample basis or in blocks or frames, and thereafter subtracting the resulting squared signals to determine the difference in average signal level. Subsequently, a discrete summation over a predetermined number of samples of the difference in average signal level may be performed to determine the differential level value. Alternatively, the first and second input signals may be individually squared and integrated, or summed, before the resulting integrated signals are subtracted from each other to determine the differential level value.

According to a preferred embodiment of the invention, the first and second input signals are represented by respective 16 bit digital signals sampled at 16 kHz. Each of the digital signals is divided into frames of that each contains about 32–512 samples, such as 56 samples, corresponding to time segments of about 3.5 milliseconds, and each sample in the frame squared to obtain respective power estimates. The power estimates are subtracted and the subtracted power estimate subsequently subjected to a discrete summation to determine the differential level value of the two frames in question and subsequently added to a previously stored value of the differential level to obtain a current value of the differential level. By summing or integrating a plurality of successively determined differential level values, this current value of the differential level will represent a mapping of a long-term estimate of the difference in average signal level between the first and second input signals. After the current differential level value has been determined, it's numerical value is compared to the threshold value to determine how to reduce the difference in average signal level through appropriate adjustment the correction parameter value. Preferably, the value of the correction parameter is adjusted up or down in case the numerical value of the differential level is larger than the threshold value according to a sign of the differential level value. The value of the correction parameter is preferably retained in case that the current numerical value of the differential level is smaller than the threshold value. If the latter is the case, the current value of the differential level is simply stored in a general purpose register of the DSP and thus ready for being updated during the next calculation of its value as described above.

If the difference in average signal level between the first and second input signals is represented by a subtraction of the average signal levels, the threshold value may be selected within a range of 0.01–0.04, preferably between 0.016 and 0.02, corresponding to differences of 0.04–0.17 dB in integrated signal power between the first and second input signals. Two threshold values, symmetrically arranged with respect to 1.0, such as 0.984 and 1.016, may be utilised in case that the difference in average signal level between the first and second input signals is represented by a ratio.

By making a running determination of the differential level value and only adjust the correction parameter value once the threshold value, or one of the threshold values, has been reached, it has been avoided that short term fluctuations in the difference in average signal level between the first and second microphones lead to relatively rapid adjustments of e.g. the gain in one or both of the input signal channels. Such rapid adjustments may generate an audible and highly objectionable modulation of one or both of the input signals, particularly if the time constants involved are too fast e.g. smaller than 20 or 60 seconds. According to the present aspect of the invention, an appropriate selection of the threshold value or values secures that only statistical significant differences in average signal level between the first and second input signals will lead to an adjustment of the correction parameter value. At the same time, it can be secured that the adjustment is made in a correct direction, i.e. actually reduces the difference in average signal level. Furthermore, since the value of the correction parameter only may need to be adjusted rather infrequently, battery power from the hearing aid's battery is also conserved.

Since the differential level value may be positive, negative or zero, it is preferred to first determine the numerical value of the differential level and subsequently compare the numerical value to the threshold value, represented as a positive number, to determine, in a simple manner, whether the threshold value has been reached. The sign of the differential level value is used by the processor to determine whether the correction parameter value should be incremented or decremented to reduce the difference in average signal level between the first and second input signals. Alternatively, the differential level value may be compared with two threshold values, e.g. of opposite sign but equal magnitude, to determine whether the differential level value is within or outside a range between the two oppositely signed threshold values. Naturally, each of the first and second input signal channels may comprise a dedicated and adjustable correction parameter so that both channels are adjusted to reduce the difference in average signal level.

Incrementing or decrementing the value of the current correction parameter may be performed in steps of a predetermined size. If the correction parameter is a gain correction factor of one of the input signal channels, the step size may have a value between 2E-16–2E-13 such as about 2E-15 corresponding to a Least Significant Bit in a 16 bit system. The predetermined step size is preferably considerably smaller, e.g. 1024–16384 times smaller, than the numerical value of the threshold which may be selected in the range 0.01–0.04, as mentioned above. By selecting a step size which is considerably smaller than the threshold value, the adaptive adjustment of the correction parameter's value is performed very slowly and it is thus secured that only long-term statistical significant differences in the average signal level between the first and second input signals are utilised to control the adjustment of the correction parameter's value.

The processor is preferably adapted to generate a directional signal by processing the first and second input signals and provide a processed directional signal to the hearing aid user. The directional signal may be generated by delaying one of the input signals with respect to the other and subsequently subtract the input signals from each other to form the directional signal. The directional signal may be generated solely in one particular listening program of a number of different listening programs provided in the hearing aid so as to allow a user to select between listening to a directionally processed/amplified acoustic signal or listening to a omni-directional acoustic signal.

The correction parameter may comprise a gain correction factor and/or a filter parameter controlling a frequency response of the at least one input signal channel. A difference in average signal level between the first and second input signals may be due to a mismatch in gain between the first and second input channels and/or a difference in sensitivity between the associated microphones. Large values of the difference in average signal level may, however, also arise because of frequency response differences between the first and second input channels and/or between the respective microphones. It may, in some embodiments of the invention, be desirable to match the input signal channels over only a particular part of a total bandwidth of the input signal channels. This may be accomplished by inserting lowpass, bandpass or highpass filters or algorithms into an adaptive level matching algorithm before the difference average signal level is computed. A bandpass filter with a passband located in the range 200 Hz–1 KHz may be utilised to optimise the matching between the first and second input signal channels in a low frequency range of the total bandwidth.

Amplitude response deviations as small as 1–2 dB at low frequencies, i.e. approximately 100 Hz–1 kHz, between the input signal channels will significantly reduce a low-frequency directionality of the directional signal. Consequently, to compensate for such adverse effects, compensating filter means such as a filter circuit or filter algorithm may be inserted in the at least one input signal channel. The correction parameter preferably controls a pole and/or zero location of an compensating IIR or FIR filter in such a manner that the above-described amplitude response deviations are fully or at least partly compensated.

While some of the prior art systems for adaptive microphone matching in hearing aids have focused on feed-forward correction of detected differences in signal levels, the present applicant prefers to perform the adjustment of the correction parameter prior to the difference in average signal level is determined. Thereby, feedback correction is applied to any detected difference in the average signal level. Where forward correction is applied to one or both of the input signal channels, it must generally be performed by adjusting the correction parameter with an amount that fully compensates for the integrated difference in the average signal level because there is no information available with regards to the signal level after the correction point or stage to ascertain that an improvement in matching between the signal channels was actually obtained. Accordingly, such a feed-forward system will tend to make large correction parameter adjustments in response to large short term fluctuations in the integrated difference in average signal level even in situations where the long-term signal levels actually are balanced. As previously described, this may introduce audible modulation into one or both of the input signals. According to the present invention, the differential level value is compared to the threshold value and the threshold value may conveniently be selected so as to secure that only statistically significant differences in average signal level between the first and second input signals lead to an adjustment of the correction parameter value.

Accordingly, if the first and second input signal channels of a hearing aid in accordance with the present invention already are balanced, random sub-threshold fluctuations in the differential level value, as mentioned above, will not cause random increments or decrements to the value of the correction parameter. Instead, the current correction parameter value is retained under such conditions.

The integration of the difference in average signal level may be performed by a non-leaky integrator so that the plurality of successively determined differential level values are summed until a current value of the differential level reaches the threshold value or falls outside a range defined by two e.g. oppositely signed threshold values.

Subsequently, the correction parameter value is appropriately adjusted to reduce the difference in average signal level and the differential level value may be reset, i.e. set to a value that represents no differential level value. Thereafter, the integration of the difference in average signal level may be allowed to continue. A significant advantage of this methodology is that the processor is relieved from calculating and storing long-term power estimates of correspondingly long input signal segments even though the integration process leads to differential level values which each may represent very long input signal segments. Such long-term power or signal level estimates may be difficult to represent in a fixed-point processor such as a 16 bit DSP.

According to a preferred embodiment of the invention, the processor is adapted to calculate a spectral estimate of a first signal and compare the spectral estimate to a predetermined criteria to control the adjustment of the correction parameter value. The adjustment of the correction parameter value may be controlled so that a current value of the correction parameter is retained when the spectral estimate of the first signal falls outside the predetermined criteria. When, or if, the spectral estimate of the first signal again falls inside the criteria, the current value of the correction parameter is adjusted so as to increment or decrement the value thereof. A major advantage of the proposed solution is that erroneous adjustments of the correction parameter value are avoided in situations where the hearing aid oscillates or the input signal to the first and second microphone has a very narrow bandwidth, e.g. if the input signal is a sine wave.

The average signal level of the first and second input signals and their difference may be represented by anyone of a number of different well-known level estimates such as absolute or rectified amplitude estimates, RMS amplitude estimates, energy estimates, power estimates etc.

The first and second input signals channels preferably comprise respective analogue-to-digital converters to provide the first and second input signals as respective digital signals, and the processor comprises a DSP adapted to receive and process the respective digital signals to generate the directional signal. By adapting a DSP to perform the operations of the processor, several advantages are provided: the correction factor adjustment, the integration of the difference in average signal level and the comparison between the differential level value and the threshold value may be performed by simple algebraic operations using a MAC and associated general purpose registers of the DSP. The DSP may be a software programmable device wherein operations or algorithms are controlled by executing a predetermined set of instructions stored within an associated Random Access Memory (RAM).

A second aspect of the invention relates to a hearing aid comprising:

a first input signal channel adapted to generate a first input signal associated with a first microphone, a second input signal channel adapted to generate a second input signal associated with a second microphone, and a processor adapted to determine a difference in average signal level between the first and second input signals and calculate a spectral estimate of a first signal, integrate the difference in average signal level over time to determine a differential level value; and adjust a correction parameter value of at least one input signal channel based on the differential level value to reduce the difference in average signal level between the first and second input signals, characterised in that the spectral estimate of the first signal is compared to a predetermined criteria to control the adjustment of the correction parameter value.

The spectral estimate of the first signal may be obtained by applying well-known spectral estimation techniques such as Linear Predictive Coding, Discrete Fourier Transform, Fast Fourier Transform, filter bank analysis etc.

The adjustment of the correction parameter value may be controlled so that a current value of the correction parameter is retained when the spectral estimate of the first signal falls outside the predetermined criteria. When the spectral estimate of the first signal again falls inside the criteria, the current value of the correction parameter is adjusted so as to increment or decrement the value thereof. Accordingly, values of the differential level which are obtained while the spectral estimate of the first signal falls outside the predetermined criteria are discarded and will not lead to any adjustment of the correction parameter value. If the adjustment of the correction parameter value is performed in steps of a predetermined size, then an alternative to suspending the adjustment of the correction parameter value is to reduce the step size to significantly smaller value than the predetermined size, such as 5 or 10–100 times smaller.

As previously mentioned, one advantage provided by this aspect of the invention is that erroneous adjustments of the value of the correction parameter are avoided in situations where the hearing aid in an oscillatory state, or in situations where a narrow-band acoustic signal is applied to the first and second microphones, e.g. a sine wave signal. A hearing aid in an oscillatory state, caused by an acoustic and/or mechanical feedback loop, will usually have a feedback transfer function that contains contributions from each of the active microphones. The individual microphone contributions to the feedback transfer function will be generally be of different magnitude due to minor differences in physical placement and orientation of the microphones in the hearing aid housing. Accordingly, the first and second microphone signals, and thereby also the first and second input signals, will generally display quite different levels when the hearing aid oscillates, even when the two input signal channels are actually perfectly matched. Unless special precautions are taken, an adaptive matching system will automatically misalign the first and second input signal channel in an effort to balance the apparently very differing levels of the first and second input signals. Because hearing aid oscillation occurs quite frequently, unfortunately, the present applicant's solution to that problem constitutes a major advance in the art.

The first signal may be the first or the second input signal or a signal derived from either the first or the second signal. In a directional hearing aid wherein the directional signal may be obtained by subtracting the first and second input signals from each other, the directional signal may also serve as the first signal or it may be derived from other combinations of the first and the second input signal.

The predetermined criteria is preferably based on minimum and maximum values of the spectral estimate of the first signal. In one embodiment of the invention, frequencies for the minimum and maximum values of the spectral estimate are determined by the processor and a difference between these minimum and maximum values is compared to a limit value so that spectral estimates having min/max differences smaller than the limit value are considered to fulfil the predetermined criteria while spectral estimates with min/max differences larger than the limit value are considered outside the criteria. This method allows the processor to discriminate between narrow and wideband input signals and only adjust the value of the correction parameter solely when a sufficiently wideband first signal is present. Alternatively, 3 dB or 6 dB bandwidths of the spectral estimate of the first signal could be determined and utilised as a basis for the decision to suspend or carry on with the adaptive adjustment of the correction parameter.

The adjustment of the correction parameter value may be performed in one step that substantially eliminates the determined difference in average signal level between the first and second input signals, i.e. a methodology that seeks to match the input signal channels based on a single differential level value. This may be accomplished by applying feedforward or feedback adjustment of the correction parameter.

The adjustment of the correction parameter value may, alternatively, be performed by comparing the differential level value to a threshold value and retaining the correction parameter value when the numerical value of the differential level is smaller than the threshold value while incrementing or decrementing the correction parameter value when the numerical value of the differential level is larger than the threshold value according to a sign of the differential level value. The correction parameter value may be incremented or decremented in steps, each step having a size 10–100 times smaller than the threshold value, as previously mentioned. The correction parameter may comprise a gain correction factor and/or a filter parameter controlling a frequency response of the at least one input signal channel. Each input signal channel may also comprise one or several correction parameters e.g. a first correction parameter that adjusts the gain in the first or second input channel and a second correction parameter that adjusts an amplitude and/or phase response of said first or second channel.

A third aspect of the invention relates to a hearing aid comprising:

a first input signal channel adapted to generate a first input signal associated with a first microphone, a second input signal channel adapted to generate a second input signal associated with a second microphone, and a processor adapted to:

determine a difference in average signal level between the first and second input signals, compare the difference in average signal level to a threshold value, integrate the difference in average signal level over time when the difference in average signal level is smaller than the threshold value to determine a differential level value, suspend the integration of the difference in average signal level when the difference in average signal level is larger than the threshold value, adjust a correction parameter value of at least one input signal channel based on the differential level value to reduce the difference in average signal level between the first and second input signals.

According to the latter aspect of the invention, the hearing aid's processor monitors whether the determined difference in average signal level between the first and second input signals indicates that anomalous input signal conditions exist. Such conditions may be caused e.g. by the previously mentioned hearing aid oscillation or by hardware failures such as a defective microphone or shortened signal leads. If the difference in average signal level is larger than the threshold value the processor suspends or halts the integration of the difference in average signal level. This assures that the calculation of the differential level value is based on appropriate input signal conditions and not contributions from anomalous input signals. The threshold value is therefore preferably set to a value sufficiently large that it will not be reached unless the previously-mentioned anomalous input signal conditions, or hardware failures, are present.

According to a preferred embodiment of the invention, the hearing aid is equipped with a pair of unmatched omni-directional microphones and an initial compensation of measured differences in average signal level between the first and second input signals is performed during a manufacturing of the hearing aid. Values of a gain constant is individually determined for each hearing aid by measuring the differences in average signal level and calculate an appropriate compensating value of the gain constant. The value of the gain constant is subsequently stored in a non-volatile memory location and loaded into an adaptive matching algorithm of the DSP when the hearing aid battery supply is activated. The adaptive matching of the input signal channels thereafter operates to compensate for long-term drift in this initial compensation by determining the difference in average signal level between the first and second microphones during actual operation of the hearing aid and adjust and store the value of the gain constant to maintain optimum matching over the life-time of the hearing aid. When the above-described initial compensation of measured differences in average signal level is performed, the threshold value to which the difference in average signal level is compared may be set to a relatively low value compared to a case where unmatched microphone pairs are utilised so that the adaptive matching algorithm must be able to converge even though there may exist a relatively large initial difference in average signal level between the first and second input signals in worst case situations. It is likely that such an unmatched microphone pair will display a sensitivity difference in a range of 2–6 dB. Consequently, if the processor is adapted to compare the difference in average signal level to the threshold value and suspend the integration of the difference in average signal level if this difference is too large, i.e. larger than the threshold, the threshold value must be set to a sufficiently large value to avoid dead-lock situations. The processor is preferably further adapted to compare the differential level value to a second threshold value and retain a current correction parameter value if the differential level value is smaller than the second threshold value. The current correction parameter value is incremented or decremented if the differential level value is larger than the second threshold value based on a sign of the differential level value.

A fourth aspect of the invention relates to a method of adaptively balancing input signal channels of a hearing aid, the method comprising the steps of:

providing a first input signal in a first input signal channel associated with a first microphone and providing a second input signal in a second input signal channel associated with a second microphone determining a difference in average signal level between the first and second input signals and integrating the difference in average signal level over time to determine a differential level value, comparing the differential level value to a threshold value, adjusting a correction parameter value of at least one input signal channel based on the result of said comparison to reduce the difference in average signal level between the first and second input signals.

The method may comprise the further steps of retaining a current value of the correction parameter if the differential level value is smaller than the threshold value, and incrementing or decrementing the current correction parameter value if the differential level value is larger than the threshold value according to a sign of the differential level value.

A fifth aspect of the invention relates to a method of adaptively balancing input signal channels of a hearing aid, the method comprising the steps of:

providing a first input signal in a first input signal channel associated with a first microphone and providing a second input signal in a second input signal channel associated with a second microphone, calculating a spectral estimate of a first signal, determining a difference in average signal level between the first and second input signals, integrating the difference in average signal level over time to determine a differential level value;

adjust a correction parameter value of at least one input signal channel based on the differential level value to reduce the difference in average signal level between the first and second input signals and comparing the spectral estimate of the first signal to a predetermined criteria to control the adjustment of the correction parameter value.

The adjustment of the correction parameter value is preferably suspended when the spectral estimate of the first signal is falls outside the predetermined criteria.

A sixth aspect of the invention relates to a method of adaptively balancing input signal channels of a hearing aid, the method comprising the steps of:

providing a first input signal in a first input signal channel associated with a first microphone and providing a second input signal in a second input signal channel associated with a second microphone, determining a difference in average signal level between the first and second input signals and comparing the difference in average signal level to a threshold value, integrating the difference in average signal level over time when the difference in average signal level is smaller than the threshold value to determine a differential level value, suspending the integration of the difference in average signal level when the difference in average signal level is larger than the threshold value, adjusting a correction parameter value of at least one input signal channel based on the differential level value to reduce the difference in average signal level between the first and second input signals.

BRIEF DESCRIPTION OF THE DRAWINGS

A preferred embodiment of the present invention in the form of a multi-program directional hearing aid based on a software programmable proprietary DSP will be described in the following with reference to the drawings, wherein.

DETAILED DESCRIPTION OF A PREFERRED EMBODIMENT

Figure 1:
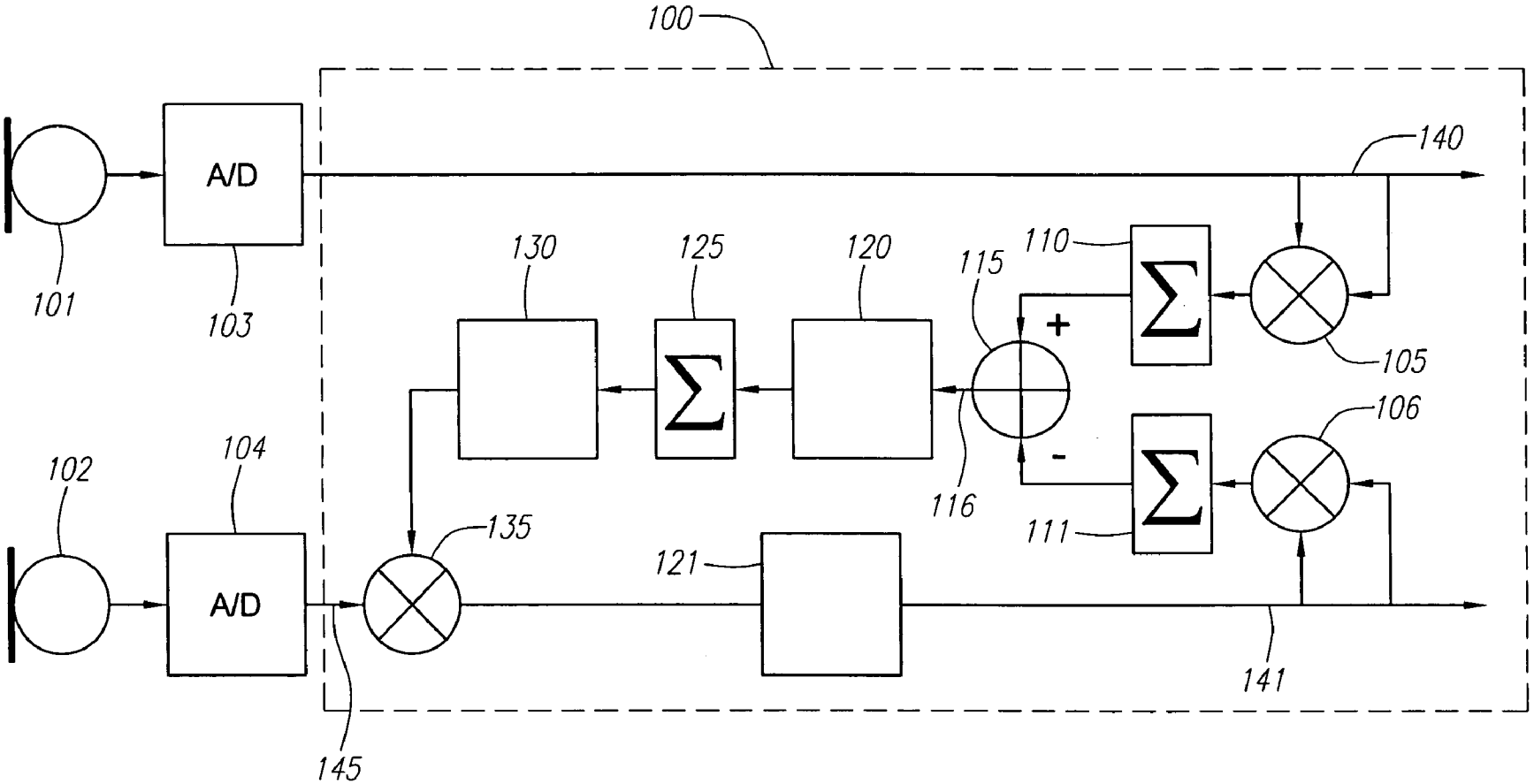
FIG. 1 is a signal flow diagram of an adaptive microphone matching algorithm for the software programmable DSP based hearing aid according to the invention.

FIG. 1 illustrates, in simplified form, a signal flow diagram of an adaptive microphone matching algorithm 100 implemented by a program routine in a software programmable and low power proprietary DSP (not shown). Clearly, the disclosed signal flow diagram may also be realised in a commercially available software programmable DSP or by a hard-wired proprietary DSP operating according to a fixed set of instructions or in a DSP build in programmable logic technology, such as FPGA technology.

The adaptive matching algorithm 100 seeks to balance an average broad band gain of two input signal channels and their associated microphones. The adaptive microphone matching algorithm 100 is preferably designed to continuously operate during normal use of the hearing aid so as to compensate any long-term drift in the balance between the microphones and/or circuitry within the input signal channels.

Also shown in FIG. 1 is a pair of omni-directional microphones 101, 102 each having an associated input signal channel with an analogue-to-digital converter 103 or 104. In the first input signal channel, a microphone 101 generates a microphone signal which supplied to the first analogue-to-digital converter (A/D) 103. The A/D 103 and the other A/D 104 are preferably of a sigma-delta type and adapted to sample the associated microphone signal with sample rate of about 1 MHz. An integrated decimator filter is adapted to decimate the oversampled output signals to provide respective 16 kHz sampled digital signals with 16 bit resolution. A first digital input signal 140, or first input signal, is transmitted to the low power proprietary DSP.

In the second input signal channel, microphone 102 generates a microphone signal which supplied to the second analogue-to-digital converter (A/D) 104 which generates the second digital signal which subsequently is supplied to a gain scaling algorithm 135 which multiplies the second digital signal with a 16 bit gain constant, K. The value of K may initially, during the manufacturing process of the hearing aid, be set to 1 so as to maintain balance or matching between the input signal channels if the microphones and circuitry within the channels are already matched. A static matching filter 121 is optionally provided in the second input signal channel after the gain scaling algorithm or operator 135. This static matching filter 121 may be utilised to compensate for initial frequency response and/or gain differences between the first and second microphone, 101, 102, respectively, that are detected/measured during the manufacturing of the hearing aid. A programming system adapted to communicate with the hearing aid during manufacturing or testing may utilise measured frequency response data for the first and second input signal channels to calculate an optimum setting of the static matching filter's coefficients.

An output signal 141 of the static matching filter 121 constitutes a second input signal for the DSP that may be adapted to delay output signal 141 with e.g. 20–75 μS and subtract it from the first input signal 141 to form a resulting directional signal in well-known manner. The delay of the output signal 141 may alternatively be implemented in the decimator part of the A/D converters 103 and 104.

Multiplier 105 is used to square the first input signal 140 and a summing unit or operation 110 is used to form a discrete summation of the squared first input signal over a frame of 56 samples. Thereby, providing a first averaged power estimate to an input of a subtractor 115. A corresponding averaged power estimate over a frame of the second input signal 141 is also provided to the subtractor 115. The subtractor accordingly determines or calculates a power signal 116 that represent a difference in average power between the first and second input signals, 140, 141, respectively, and provides this power signal 116 to an optional first comparator 120, the operation of which will be explained later for the sake of clarity. The power signal is subjected to an integration, or discrete summation, in a second integrator 125 to integrate the difference in average power level over time and provide a differential level value. In order to further reduce the computational burden of the DSP, the present inventors have found it advantageous to undersample the first and/or second input signals with a factor between 2 and 8 such as about 4 before the respective averaged power estimates are calculated. Even though such undersampling of the input signals will generate some amount of aliasing noise, assuming that the input signals already are sampled close to the Nyquist rate, the undersampling has little effect on the average power estimates. Consequently, the proposed undersampling of the input signals provides an effective method of saving the DSP for a substantial computational load.

During normal operation of the adaptive matching algorithm 100, i.e. where no lo anomalous input signal conditions are detected, the differential level value is continuously updated, in the present embodiment for each frame of 56 samples, to form a current value of the differential level which represents the integrated difference in average power over a time period that stretches from the present and back to the time where the second integrator 125 was initialized or reset. This second integrator is preferably a non-leaky integrator. The current value of the differential level is transferred to a second comparator 130 that compares a numerical value of the current differential level to a predetermined threshold value. If the numerical value of the current differential level is smaller than the threshold value, the current value of the 16 bit gain constant, K is retained and if the numerical value of the current differential level is larger or equal to the threshold value, the value of K is incremented or decremented so as to reduce the difference in average signal power between the first and second input signals.

The threshold value is preferably selected to about 0.016 corresponding to a long-term difference in average signal power between the first and second input signals of about 0.07 dB. The 16 bit gain constant, K is preferably incremented or decremented in steps of 2E-15 corresponding to one LSB in a signed fixed point 16 bit system. The small value of K combined with a threshold value so large that only statistically significant differences in average signal level between the input signals will be lead to adjustments of K, provides the adaptive microphone matching algorithm 100 with long time constants without requiring the hearing aid's DSP to integrate the levels or power of the input signals over very long time intervals. Long time intervals inevitably leads to numerical problems associated with representing very small numbers in a fixed point system.

After each adjustment of the value of K, the current value of K is written to an external EEPROM (not shown) via a build-in serial interface of the proprietary DSP. After the hearing aid's power supply has been turned on, the DSP is initialised and the current value of K is read by the DSP's application program and transferred to the gain scaling operator 135.

The optional first comparator 120 is preferably also inserted into the adaptive microphone matching algorithm 100, as mentioned above. The first comparator compares the power signal 116, which represented the difference in average power level between the first and second input signals over one frame to an upper threshold value. The upper threshold value has been selected so that only anomalous input signal conditions, which may be caused e.g. by the previously mentioned hearing aid oscillation or by hardware failures such as a defective microphone or shorted signal or power supply leads, will cause the power signal 116 to attain values larger the upper threshold value. Power signals 116 larger than the upper threshold value of the first comparator 120 are therefore skipped and not transferred to the second integrator 125.

Figure 2:
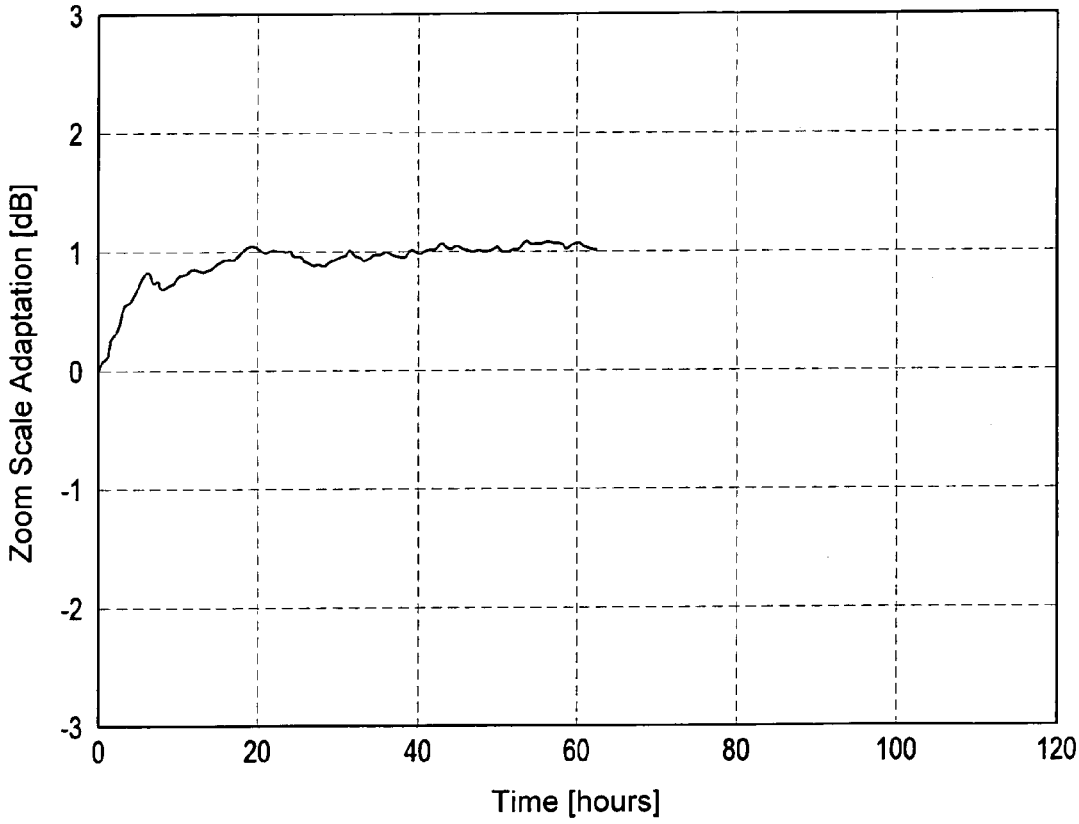
FIG. 2 is a graph showing long-term logged values of a 16 bit gain constant, K, as calculated by the software programmable DSP during a field trial of a hearing aid comprising the present adaptive microphone matching algorithm

FIG. 2 is a MATLAB® plot of logged data of the development over time of the value of the 16 bit gain constant, K, plotted in dB on the Y-axis, versus utilization time of the hearing aid, plotted on the X-axis in hours. The initial setting of K, as obtained during manufacturing, is set to 0 dB. During actual operation, i.e. daily use of the hearing aid, it can be seen that the initial value of K undergoes a gradual adjustment during the first 40 hours of use, corresponding to about 5 days. K appears to reach an asymptotic value of about 1 dB or 1.12 after about 60 hours of use. This adaptive long-term adjustment of K, reflects a not entirely accurate initial compensation of the average signal level between the input signal channels and/or differences related to changes in an acoustical environment of the microphone pair. The latter changes being related to differences in sound propagation/reflections around the microphone pair in the acoustic test box used during the manufacturing process and the placement near the hearing aid user's head and ear.

The invention claimed is:

1. A hearing aid comprising:

a first input signal channel adapted to generate a first input signal associated with a first microphone, a second input signal channel adapted to generate a second input signal associated with a second microphone, and a processor adapted to:

determine a difference in average signal level between the first and second input signals, integrate the difference in average signal level over time to determine a differential level value and compare the differential level value to a threshold value, adjust a correction parameter value of at least one input signal channel based on the result of said comparison to reduce the difference in average signal level between the first and second input signals.

2. A hearing aid according to claim 1, wherein the correction parameter comprises a gain correction factor and/or a filter parameter controlling a frequency response of the at least one input signal channel.

3. A hearing aid according to claim 1, wherein the adjustment of the correction parameter is performed before the difference in average signal level is determined, thereby applying feedback correction of detected differences in the integrated average signal level between the input signal channels.

4. A hearing aid according to claim 1, wherein the adjustment of the correction parameter value comprises:

retaining a current correction parameter value if the differential level value is smaller than the threshold value, and incrementing or decrementing the current correction parameter value if the differential level value is larger than the threshold value according to a sign of the differential level value.

5. A hearing aid according to claim 4, wherein the increment or decrement of the current correction parameter value is obtained in a step of predetermined size.

6. A hearing aid according to claim 5, wherein the predetermined step size is considerably smaller than the threshold value's numerical value.

7. A hearing aid according to claim 1, wherein the processor is further adapted to:

reset the differential level value after the threshold value has been reached.

8. A hearing aid according to claim 7, wherein the integration of the difference in average signal level is performed by a non-leaky integrator.

9. A hearing aid according to claim 1, wherein the processor is further adopted to:

calculate a spectral estimate of first signal, compare the spectral estimate of the signal to a predetermined criteria to control the adjustment of the correction parameter value.

10. A hearing aid according to claim 1, wherein signal levels of the first and second input signals are determined from respective absolute amplitude estimates or power estimates of the first and second input signals.

11. A hearing aid according to claim 1, wherein the first and second input signals channels comprise respective analogue-to-digital converters providing the first and second input signals as respective digital signals, and the processor comprises a Digital Signal Processor adapted to receive and process the respective digital signals to generate the directional signal.

12. A hearing aid according to claim 11, wherein operations of the Digital Signal Processor are controlled by a predetermined set of instructions stored in a Random Access Memory of the hearing aid.

13. A hearing aid comprising:

a first input signal channel adapted to generate a first input signal associated with a first microphone, a second input signal channel adapted to generate a second input signal associated with a second microphone, and a processor adapted to:

determine a difference in average signal level between the first and second input signals, calculate a spectral estimate of a first signal, integrate the difference in average signal level over time to determine a differential level value;

adjust a correction parameter value of at least one input signal channel based on the differential level value to reduce the difference in average signal level between the first and second input signals, characterised in that the spectral estimate is compared to a predetermined criteria to control the adjustment of the correction parameter value.

14. A hearing aid according to claim 13, wherein the adjustment of the correction parameter value is suspended when the spectral estimate fails to fulfil the predetermined criteria.

15. A hearing aid according to claim 13 or 14, wherein the predetermined criteria is based on minimum and maximum values of the spectral estimate.

16. A hearing aid according to 13, wherein the first signal is the first or the second input signal or a signal derived from a combination of the first and the second input signal.

17. A hearing aid according to claim 13, wherein the adjustment of the correction parameter value is performed in one step that substantially eliminates the determined difference in average signal level between the first and second input signals.

18. A hearing aid according to claim 13, wherein the adjustment of the correction parameter value comprises:

comparing the differential level value to a threshold value, retaining the correction parameter value when the numerical value of the differential level is smaller than the threshold value, and incrementing or decrementing the correction parameter value when the numerical value of the differential level is larger than the threshold value according to a sign of the differential level value.

19. A hearing aid according to claim 13, wherein the correction parameter comprises a gain correction factor and/or a filter parameter controlling a frequency response of the at least one input signal channel.

20. A hearing aid comprising:

a first input signal channel adapted to generate a first input signal associated with a first microphone, a second input signal channel adapted to generate a second input signal associated with a second microphone, and a processor adapted to:

determine a difference in average signal level between the first and second input signals, compare the difference in average signal level to a threshold value, integrate the difference in average signal level over time when the difference in average signal level is smaller than the threshold value to determine a differential level value, suspend the integration of the difference in average signal level when the difference in average signal level is larger than the threshold value, adjust a correction parameter value of at least one input signal channel based on the differential level value to reduce the difference in average signal level between the first and second input signals.

21. A hearing aid according to claim 20, wherein the processor is further adapted to:

compare the differential level value to a second threshold value, retain a current correction parameter value if the differential level value is smaller than the second threshold value, increment or decrement the current correction parameter value if the differential level value is larger than the second threshold value based on a sign of the differential level value.

22. A method of adaptively balancing input signal channels of a hearing aid, the method comprising the steps of:

providing a first input signal in a first input signal channel associated with a first microphone, providing a second input signal in a second input signal channel associated with a second microphone, determining a difference in average signal level between the first and second input signals, integrating the difference in average signal level over time to determine a differential level value, comparing the differential level value to a threshold value, adjusting a correction parameter value of at least one input signal channel based on the result of said comparison to reduce the difference in average signal level between the first and second input signals.

23. A method according to claim 22, further comprising the step of:

retaining a current value of the correction parameter if the differential level value is smaller than the threshold value, and incrementing or decrementing the current correction parameter value if the differential level value is larger than the threshold value according to a sign of the differential level value.

24. A method of adaptively balancing input signal channels of a hearing aid, the method comprising the steps of:

providing a first input signal in a first input signal channel associated with a first microphone, providing a second input signal in a second input signal channel associated with a second microphone, calculating a spectral estimate of a first signal, determining a difference in average signal level between the first and second input signals, integrating the difference in average signal level over time to determine a differential level value;

adjust a correction parameter value of at least one input signal channel based on the differential level value to reduce the difference in average signal level between the first and second input signals, characterised in that the spectral estimate is compared to a predetermined criteria to control the adjustment of the correction parameter value.

25. A method according to claim 24, comprising the further steps of:

suspending the adjustment of the correction parameter value when the spectral estimate fails to fulfil the predetermined criteria.

26. A method of adaptively balancing input signal channels of a hearing aid, the method comprising the steps of:

providing a first input signal in a first input signal channel associated with a first microphone, providing a second input signal in a second input signal channel associated with a second microphone, determining a difference in average signal level between the first and second input signals, comparing the difference in average signal level to a threshold value, integrating the difference in average signal level over time when the difference in average signal level is smaller than the threshold value to determine a differential level value, suspending the integration of the difference in average signal level when the difference in average signal level is larger than the threshold value, adjusting a correction parameter value of at least one input signal channel based on the differential level value to reduce the difference in average signal level between the first and second input signals.

* * * * *